US007134511B2

(12) United States Patent
Mayr et al.

(10) Patent No.: US 7,134,511 B2
(45) Date of Patent: Nov. 14, 2006

(54) SOIL WORKING METHOD AND DEVICE

(75) Inventors: Markus Mayr, Ehekirchen (DE); Markus Riepold, Brunnen (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 267 days.

(21) Appl. No.: 10/838,302

(22) Filed: May 5, 2004

(65) Prior Publication Data

US 2004/0222017 A1 Nov. 11, 2004

(30) Foreign Application Priority Data

May 8, 2003 (DE) ..... 103 20 662

(51) Int. Cl.
*E21B 44/00* (2006.01)

(52) U.S. Cl. ..... 175/27; 175/48

(58) Field of Classification Search ..... 175/25, 175/27, 48

See application file for complete search history.

(56) References Cited

U.S. PATENT DOCUMENTS 2,005,889 A * 6/1935 Dillon et al. ..... 173/3
2,455,917 A * 12/1948 Crake ..... 254/267
3,155,171 A * 11/1964 Kurt et al. ..... 173/4
3,962,879 A 6/1976 Turzillo
4,354,233 A * 10/1982 Zhukovsky et al. ..... 702/9
5,913,371 A 6/1999 Jenne
6,116,819 A 9/2000 England
6,293,359 B1 * 9/2001 Dobran et al. ..... 175/195
6,637,522 B1 * 10/2003 Wilson et al. ..... 175/25

FOREIGN PATENT DOCUMENTS

| | | |
|---|---|---|
| DE | 199 24 200 | 11/2000 |
| DE | 197 08 997 C2 | 8/2002 |
| EP | 0 517 329 A1 | 12/1992 |
| FR | 2 642 791 | 8/1990 |
| GB | 2 010 361 A | 6/1979 |

* cited by examiner

*Primary Examiner*—William Neuder
(74) *Attorney, Agent, or Firm*—Jacobson Holman PLLC

(57) ABSTRACT

A soil working method and device, in which a drilling rod, to which is fitted at least one drilling tool, is rotated about a rotation axis with a speed using a rotary drive. The drilling rod is simultaneously lowered into a soil area in the direction of the rotation axis using a feed drive and with a feed rate. The drilling rod speed is determined and a control device decreases the feed rate when the drilling rod speed is reduced.

16 Claims, 2 Drawing Sheets

SOIL WORKING METHOD AND DEVICE

BACKGROUND OF THE INVENTION

1. Field of the Invention

The invention relates to a soil working method and to the associated device.

2. Description of Related Art

Soil or ground drilling or boring methods and devices have been known for many years. In these known methods a tool is rotated and simultaneously advanced in the soil in the direction of its rotation axis, so that a hole is made in the ground. As a result of the frictional forces between the tool and the wall, as well as the base of the hole, in the known methods the tool can become blocked, i.e. the torque available for rotating the tool is no longer able to overcome the frictional forces and as a result the rotary movement stops. Such a blocking effect makes it necessary to at least partly reextract the tool from the hole, which increases the time taken for drilling and reduces the quality of the hole.

BRIEF SUMMARY OF THE INVENTION

The object of the present invention is to provide a ground or soil working method and device allowing a continuous and particularly efficient drilling.

In the soil working method according to the invention a drilling rod, to which is fitted at least one tool, is rotated by a rotary drive at a speed about the rotation axis, the drilling rod is simultaneously lowered into a soil area in the direction of the rotation axis and at a feed rate by means of a feed drive, the speed of the drilling rod is determined and a control device reduces the feed rate when there is a decrease in the drilling rod speed.

It is a fundamental idea of the invention to control in automatic manner the feed rate as a function of the drilling rod speed by means of a control device. The control device reduces the drilling rod feed rate when there is a decrease in the drilling rod speed due to an increase in the forces between the drilling tool and a wall or bottom of the soil area. These forces can e.g. be frictional, shear or cutting forces. The reduction in the feed rate leads to a reduction in the contact pressure of the drilling tool on the bottom of the soil area and consequently a reduction in the forces counteracting the rotary movement of the drilling rod. This leads to a rise in the speed of the drilling rod and consequently a blocking of the drilling rod can be effectively prevented. If the drilling rod speed rises again, the feed rate can once again be raised by the control device. This makes it possible to set the drilling rod speed to a preset desired value. Preferably, for this purpose the speed determined is compared by the control device with the preset desired speed and the feed rate is preferably controlled by means of a PID controller of the control device. Advantageously the preset desired value corresponds to the optimum cutting speed for the soil to be worked.

A particularly preferred development of the invention is characterized in that the determined drilling rod speed is compared in the control device with a predetermined threshold value and on dropping below the latter the feed rate is lowered. The threshold value can be a single value or a value range. As a result a permitted speed range can be provided within which there is no regulation of the feed rate. The PID controller can intervene on dropping below the speed threshold. The comparison of the determined speed with the predetermined threshold preferably takes place by forming a difference.

Advantageously the feed rate is regulated in such a way that the drilling rod is at least operated with a predetermined minimum desired speed. This permits a particularly continuous drilling process. Preferably the minimum desired speed is determined in such a way that sedimentation of a suspension in the soil area is reliably counteracted. Such a suspension can be introduced into or produced in the soil area for the making of foundation elements. Advantageously the drilling tool is designed in such a way that it continuously circulates the suspension. The minimum desired speed can then be dimensioned in such a way that the circulation process prevents suspension sedimentation. As a result of such a further development of the invention it is possible to produce particularly high quality foundation elements.

Appropriately the speed is determined by using rotary encoders, particularly high precision, electronic rotary encoders. This makes it possible to use the speed directly as a control quantity for regulating the feed rate and permits a particularly simple performance of the method.

A further advantageous development of the invention is characterized in that the rotary drive is constituted by a hydraulic rotary motor to which a hydraulic fluid is supplied. Such a hydraulic rotary motor permits a particularly robust operation of the drilling tool. It is also preferred that the pressure of the hydraulic fluid supplied to the hydraulic rotary motor is measured and that the speed is calculated by the control device from the pressure found using calculation instructions. This permits a particularly rapid, time-near determination of the speed and the divergence of the speed from the desired value even in the case of low speeds. In addition, minor divergences between the speed and the desired value can be reliably determined. The calculation instructions can be such that a relationship is provided between the speed and the pressure at the rotary drive.

Preferably the calculation instructions, initiated automatically by an operator, are adapted at specific time periods. This makes it possible to take account of the fact that the relationship between the speed and the pressure is dependent on ambient conditions, such as external temperature, hydraulic fluid temperature and the resulting friction torque of the rotary drive, the soil conditions, as well as the nature of the tool and the rotary drive. An adaptation can take place by a comparison of the speed determined using the rotary encoders with the speed determined on the basis of the calculation instructions. However, in particularly preferred manner the control device determines further parameters, such as external temperature, hydraulic fluid temperature, friction torque of the rotary drive and/or the wear state of the rotary drive and by means thereof the calculation instructions are adapted. This permits a particularly precise determination of the speed from the pressure. Appropriately the feed drive is constituted by a hydraulic motor. Such a hydraulic motor can e.g. be constructed as a rotary motor, which advances and retracts the drilling rod and rotary drive by means of a cable line mechanism. Hydraulic cylinders can also be used. Preferably the regulation of the feed rate and in particular the slowing down thereof, is brought about by regulating a hydraulic fluid flow rate through the hydraulic motor. This permits a particularly simple and reliable control of the feed rate. According to the invention, it is advantageous for at least two and in particular three drilling rods to be directly juxtaposed, that the at least two drilling rods are simultaneously rotated and that the at least two drilling rods are simultaneously lowered into the soil area at the same feed rate. Such an arrangement permits the simultaneous working over of a large soil area and in particular the formation of wall elements. The at least two drilling rods are preferably positioned parallel to one another and the drilling tools preferably have overlapping drilling cross-sections. Appropriately the control device regulates the feed rate of the drilling rod in the same way and synchronously. Appropriately each of the drilling rods has its own rotary drive.

In principle, the speed of each of the at least two drilling rods can be determined and based on the feed rate control. However, preferably, only the speed of the outer drilling rods is determined and processed by the control device. The term outer drilling rods is understood to mean those drilling rods which only have a directly adjacent drilling rod. As a speed drop as a result of a greater engagement or intervention in the ground occurs firstly at the outer rods, such a procedure reliably prevents the blocking of all the drilling rods. The drilling tools can fundamentally be any random known drilling tools. However, it is particularly advantageous for the drilling tool to have drilling helixes and/or mixing paddles. The use of mixing paddles is particularly advantageous if a suspension is introduced into and/or produced in the soil area. The mixing paddles can then be used to prevent sedimentation of the suspension.

The method according to the invention can in particular be used in all known drilling methods. In particularly preferred manner it is used in the case of displacement drilling, continuous screw or worm drilling and/or mixed-in-place methods for producing foundation elements. Displacement drilling is understood to mean a drilling process in which the soil material is displaced from the soil area, accompanied by simultaneous compaction. Mixed-in-place methods are those in which a liquid is introduced into the ground and is mixed with the soil in the area to form a self-hardening suspension.

A device according to the invention is characterized in that it is used for performing the above-described method.

BRIEF DESCRIPTION OF THE SEVERAL VIEWS OF THE DRAWINGS

The invention is described in greater detail hereinafter relative to preferred embodiments and the attached diagrammatic drawings, wherein show.

DETAILED DESCRIPTION OF THE INVENTION

Figure 1:
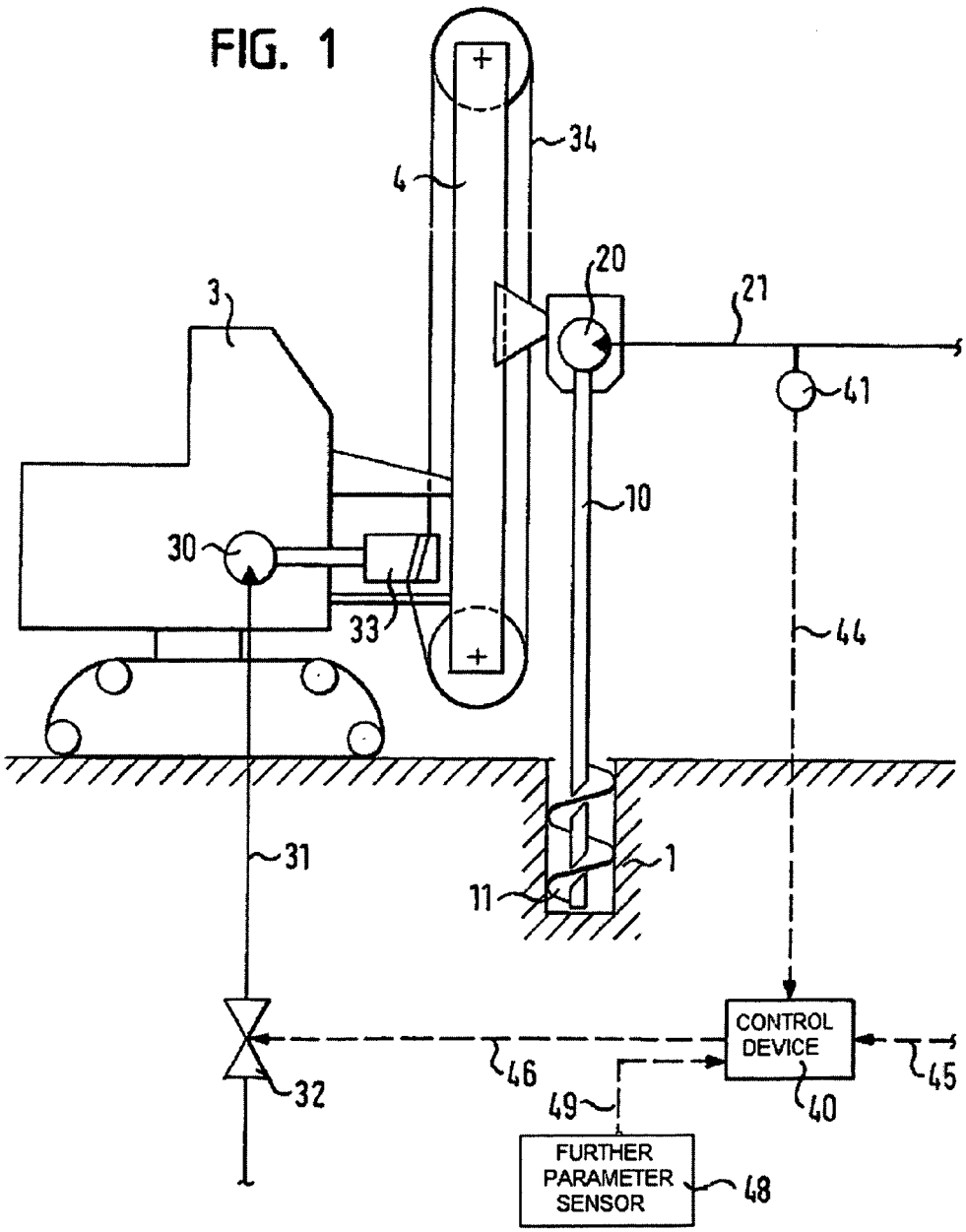
FIG. 1 A diagrammatic side view of a device for performing the method according to the invention.

In the description that follows, like parts are marked throughout the specification and drawings with the same reference numerals, respectively.

In describing preferred embodiments of the present invention illustrated in the drawings, specific terminology is employed for the sake of clarity. However, the invention is not intended to be limited to the specific terminology so selected, and it is to be understood that each specific element includes all technical equivalents that operate in a similar manner to accomplish a similar purpose.

A device for performing the method according to the invention is diagrammatically shown in FIG. 1. A rotary drive 20 in the form of a hydraulic rotary motor drives in rotary manner a drilling rod 10. Hydraulic fluid is supplied by means of a first supply line 21 to the rotary drive 20. A drilling tool 11 in the form of a drilling screw or worm is connected so as to rotate to the lower end of the drilling rod 10. At its lower end the drilling rod 10 passes into a soil area 1, where a hole is formed through the action of the drilling tool 11.

The rotary drive 20 and drilling rod 10 are displaceably placed on a mast 4 by means of an only diagrammatically shown cable line mechanism 33 and a cable 34. The cable line mechanism 33 is used for advancing the drilling rod in the direction of its rotation axis. The mast 4 is fixed in a diagrammatically represented construction vehicle 3.

The cable line mechanism 33 is driven by means of a feed drive 30 located on the construction vehicle 3 and which is also constructed as a hydraulic rotary motor. Hydraulic fluid is supplied by a second supply line 31 to the feed drive 30.

The pressure in the first supply line 21 of the rotary drive 20 is determined by means of a pressure sensor 41 and the measured value is fed by a measured value line 44 to a control device 40. The control device 40 compares the determined pressure with a desired value, which is supplied to the control device by means of a desired value line 45. From this the control device 40 calculates a set value, which is supplied by a set value line 46 to a servovalve 32 in the second supply line 31 of the feed drive 30. If the control device 40 establishes a pressure rise in the first supply line 21 reduced to below the desired value, the control device 40 reduces the hydraulic fluid flow rate through the second supply line 31 by operating the servovalve 32.

Figure 2:
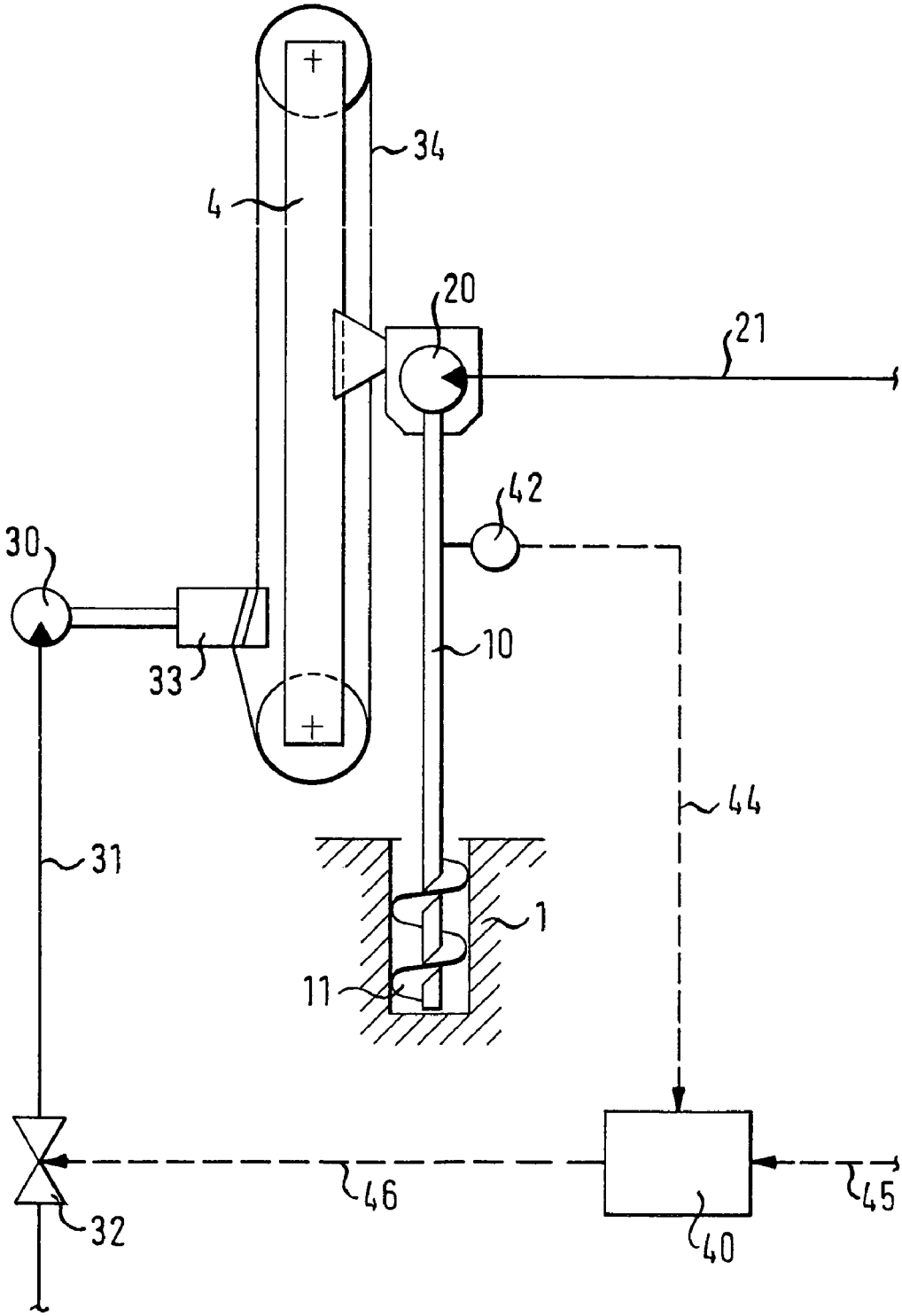
FIG. 2 A diagrammatic side view of a further device for performing the method according to the invention, without showing a construction vehicle.

Another example of a device for performing the method according to the invention is shown in FIG. 2. Components having the same function are given the same reference numerals as in FIG. 1 and will not be described again here. The embodiment of FIG. 2 differs from that of FIG. 1 only in that the speed of the drilling rod 10 is supplied to the control rod 40 instead of the pressure in the first supply line 21 as a measured value via the measured value line 46. The speed is directly recorded by a rotary encoder 42 located at the drilling rod 10.

In a further preferred manner, the control device 40 determines a further parameter as measured by a further parameter sensor 48. Data from the sensor 48 is sent to the control device 40 through line 49. Among the further parameters are external temperature, hydraulic fluid temperature, friction torque and wear state.

The embodiments described here represent only an exemplary selection. Though not explicitly mentioned here, the arrangements according to the invention can also be used in other ways that may be obvious to the user. It is to be understood that the present invention is not limited to the illustrated embodiments described herein. Modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

The invention claimed is:

1. A method for working a soil area comprising the steps of:

providing a drilling rod fitted with at least one tool;

providing a hydraulic rotary motor for providing a rotary drive for rotating the drilling rod about a rotation axis;

lowering the drilling rod into the soil area in the direction of the rotation axis by way of a feed drive having a feed rate;

measuring, by use of a pressure sensor, the pressure of a hydraulic fluid supplied to the hydraulic rotary motor;

calculating the rotation speed of the drilling rod by applying calculation instructions from a control device to the measured pressure, the calculating instructions responding to conditions that change the relationship between the rotation speed of the drilling rod and the pressure measured by the pressure sensor; and reducing the feed rate when the control device determines that there is a decrease in the rotation speed of the drilling rod.

2. Method according to claim 1, wherein the calculated rotation speed of the drilling rod is compared in control device with a predetermined threshold value and on dropping below said threshold value the feed rate is controlled in such a way that the drilling rod is at least operated with a predetermined minimum desired speed.

3. Method according to claim 2, wherein the minimum desired speed is so dimensioned that it is possible to reliably prevent sedimentation of a suspension in the soil area.

4. Method according to claim 1, wherein the rotation speed is determined by means of rotary encoders.

5. Method according to claim 1, wherein a hydraulic rotary motor serves as the rotary drive and a hydraulic fluid is supplied thereto, a pressure of the hydraulic fluid supplied to the hydraulic rotary motor is measured and the rotation speed is calculated from the determined pressure by the control device using calculation instructions.

6. Method according to claim 5, wherein the calculation instructions, are initiated automatically or by an operator, in given time periods.

7. Method according to claim 5, wherein the control device determines further parameters and by means thereof the calculation instructions are adapted.

8. The Method of claim 7, wherein the further parameter is external temperature.

9. The Method of claim 7, wherein the further parameter is hydraulic fluid temperature.

10. The Method of claim 7, wherein the further parameter is wear state of the rotary drive.

11. Method according to claim 1, wherein the feed drive is constituted by a hydraulic motor and the control of the feed rate is brought about by controlling a hydraulic fluid flow rate through the hydraulic motor.

12. Method according to claim 1, wherein at least two and in particular three drilling rods are directly juxtaposed, that the at least two drilling rods are simultaneously rotated and that the at least two drilling rods are simultaneously lowered into the soil area at the same feed rate.

13. Method according to claim 12, wherein the speed of an outer rod of the at least two drilling rods is determined.

14. Method according to claim 1, wherein the tool has bits, drilling helixes and/or mixing paddles.

15. Method according to claim 1, wherein the method is applied to displacement drilling, continuous screw drilling and/or in mixed-in-place methods for making foundation elements.

16. An apparatus for working a soil area, the apparatus comprising:

a drilling rod fitted with at least one tool;

a hydraulic rotary motor responsive to a hydraulic fluid for providing a rotary drive for rotating the drilling rod about a rotation axis;

a feed drive having a feed rate for lowering the drilling rod into the soil area in the direction of the rotation axis;

a pressure sensor for measuring the pressure of the hydraulic fluid supplied to the hydraulic rotary motor;

a control device for calculating the rotation speed of the drilling rod by applying calculation instructions to the measured pressure, the calculating instructions responding to conditions that change the relationship between the rotation speed of the drilling rod and the pressure measured by the pressure sensor; and means for reducing the feed rate when the control device determines that there is a decrease in the rotation speed of the drilling rod.

* * * * *